US006140926A

United States Patent [19]

Hayden et al.

[11] Patent Number: 6,140,926

[45] Date of Patent: Oct. 31, 2000

[54] REDUNDANT STATUS INDICATORS FOR FAULT TOLERANCE

[75] Inventors: Todd Hayden, Boise; Jay D. Reeves, Meridian, both of Id.; Lyle D. Kraft, Auburn, Calif.

[73] Assignee: Hewlett-Packard Company, Palo Alto, Calif.

[21] Appl. No.: 09/359,142

[22] Filed: Jul. 21, 1999

[51] Int. Cl.[7] ..... G08B 21/00

[52] U.S. Cl. ..... 340/635; 340/636; 340/653; 340/825.17

[58] Field of Search ..... 340/635, 636, 340/653, 333, 517, 825.16, 825.17; 307/64, 65, 43, 86, 80

[56] References Cited

U.S. PATENT DOCUMENTS 4,228,535 10/1980 Workman et al. ..... 370/220
4,528,458 7/1985 Nelson et al. ..... 307/64
4,675,539 6/1987 Nichol ..... 307/65
4,680,753 7/1987 Fulton et al. ..... 370/449
4,799,039 1/1989 Balcom et al. ..... 340/333

*Primary Examiner*—Jeffery A. Hofsass
*Assistant Examiner*—Sihong Huang

[57] ABSTRACT

A system includes multiple modules, each powered by a different power source, and a status indicator for a first of the modules. Any of the multiple modules can drive the status indicator. Each of the modules monitors the operation of the first module, driving the status indicator when the first module fails. Thus, even if a failure within the first module prevents the first module from driving the status indicator (e.g., a power failure), the status indicator is still driven by a second module.

20 Claims, 4 Drawing Sheets

REDUNDANT STATUS INDICATORS FOR FAULT TOLERANCE

FIELD OF THE INVENTION

This invention relates to the design of redundant systems. More particularly, the invention relates to redundant system status indicators.

BACKGROUND OF THE INVENTION

Technological advancement in the electronics and computer fields is continually providing newer and better products and devices that enhance our daily lives. These enhancements can be found virtually everywhere in our personal as well as business lives. As our lives become more and more reliant upon such devices, the fault tolerance of these devices needs to become greater and greater. The fault tolerance of a system refers to how well it continues to operate in the face of one or more faults, errors, or failures of its various components.

One method used to improve the fault tolerance of certain devices is referred to generally as "redundancy". In a redundant system, some or all of the components are duplicated, providing a backup component in the event a failure occurs in a primary component. One example of such redundancy is in RAID (Redundant Arrays of Independent Disks) systems, where multiple disks are used to store the same information. Thus, if one of the disks fails, another can replace it. "Failure" of a device or component typically refers to the drive or component no longer providing at least one of its functions at an expected level of operation. As a further level of fault tolerance components may receive their power from separate power sources. By using separate power sources, if either a disk or its power source fails, then another disk and power source combination is able to take its place.

However, one problem encountered in redundant systems is that of notification. In a redundant system, it would be beneficial for either the user or an administrator to know when a primary system has failed and the backup is operating in its place. One way to do this is for the failed system to provide an indication (e.g., an alert light) that it has failed. However, such an indication is ineffective if the power to the component has failed (e.g., an alert light cannot be illuminated if there is no power to illuminate it).

A similar problem is encountered in systems that do not employ redundancy. A component of the system may fail due to a problem with its power supply or power distribution within the component. Again, it would be beneficial for either the user or a system administrator to know that the component has failed. However, providing an indication (e.g., an alert light) is ineffective if the failure prevents power from getting to the indicator.

The invention described below addresses these and other disadvantages of the prior art, providing improved redundant status indicators.

SUMMARY OF THE INVENTION

A system includes multiple modules as well as a fault and/or other status indicator(s) for one of the modules. Each of the multiple modules is powered by a different power source, and any of the modules can drive the status indicator. Each of the modules monitors the operation of a first module, driving the status indicator when the first module fails. Thus, even if a failure within the first module prevents the first module from driving the status indicator (e.g., a power failure), the status indicator is still driven by a second module.

According to one aspect of the invention, the first module checks its own operation, outputting an internal failure signal upon detecting an internal error. A second module also checks the operation of the first module, outputting an external failure signal upon detecting an error in the first module. The internal and external failure signals are logically OR'd together to drive the status indicator.

According to another aspect of the invention, multiple status indicators are provided for each module. Each of these multiple status indicators (e.g., a fault indicator, an "operation ok" indicator, etc.) is driven redundantly.

DESCRIPTION OF THE DRAWINGS

The present invention is illustrated by way of example and not limitation in the figures of the accompanying drawings. The same numbers are used throughout the figures to reference like components and/or features.

DETAILED DESCRIPTION OF THE INVENTION

Figure 1:
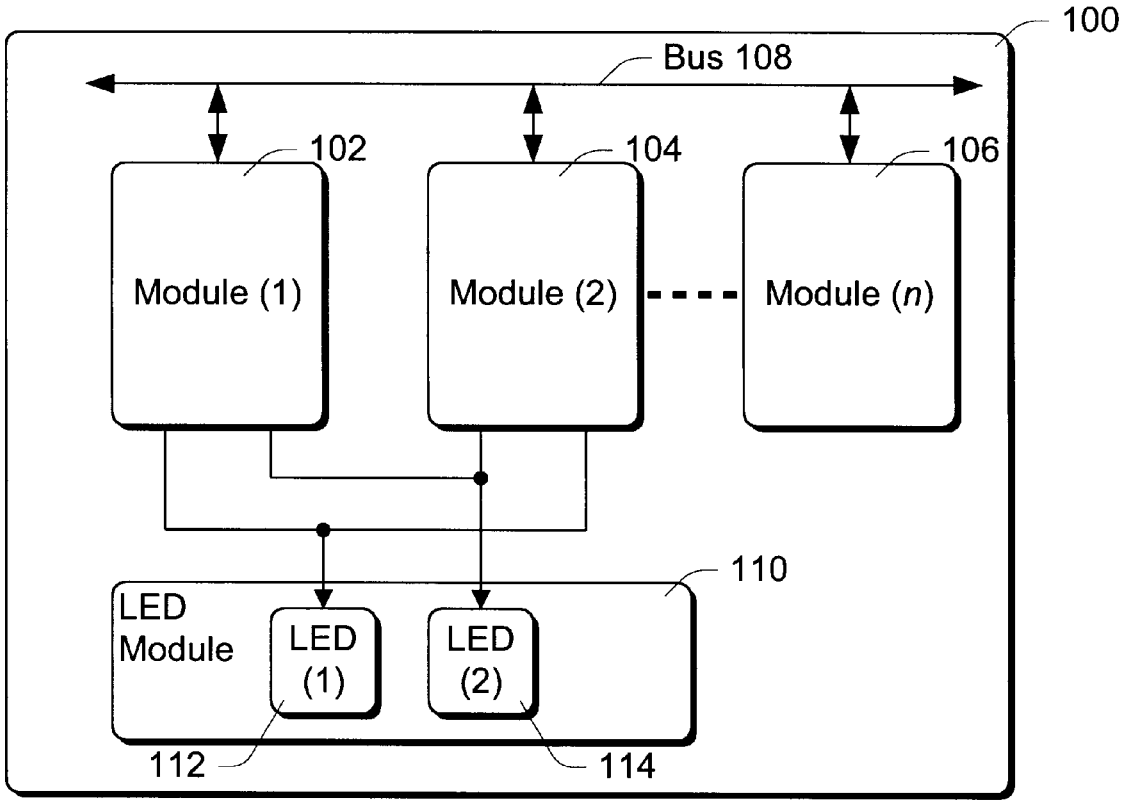
FIG. 1 shows an exemplary system having redundant status indicators in accordance with the invention.

FIG. 1 shows an exemplary system having redundant status indicators in accordance with the invention. A system 100 is illustrated including multiple (n) components or modules 102, 104, and 106. Modules 102–106 perform various functions, such as input/output (I/O) control to various I/O devices, data or instruction storage, control of transfers between two components or devices, etc. The exact functions of modules 102–106 can vary depending on the nature of system 100. The modules 102–106 are coupled to one another via a bus 108. Additionally, a light emitting diode (LED) module 110 is coupled to the modules 102–106, providing LED status indicators for the modules.

One or more of the modules 102–106 can be a backup module for one or more other modules 102–106. The redundant nature of the modules 102–106 can be either complete or partial. Complete redundancy refers to one module being capable of providing all of the functions of another module in the event the other module fails. Partial redundancy refers to one module being capable of providing some of the functions of another module in the event the other module fails. In the exemplary system 100, the modules are at least partially redundant, providing backup for status indicators as discussed in more detail below.

The modules 102–106 are coupled to and communicate with one another via the bus 108. The bus 108 can be a serial or parallel bus. Various control information and/or data can be communicated among the modules 102–106 via the bus 108. One type of information communicated on bus 108 is control information to verify the proper operation of the modules 102–106. Verification of proper operation of the modules 102–106 can be carried out in a wide variety of different manners. A module could poll another and determine that the other module is operating properly only if the proper response to the polling is provided. Alternatively, the modules may broadcast (at regular or irregular intervals) information identifying their operational characteristics.

Failure to receive such a broadcast from a module at the prescribed time would indicate the module is not operational.

Alternatively, failure of a module can be determined by monitoring status indicators of that module. By way of example, each module may have a corresponding fault indicator (e.g., a red LED) in LED module 110 that is illuminated when the module is faulty, and a corresponding "operation ok" indicator (e.g., a green LED) in LED module 110 that is illuminated when the module is operating satisfactorily. The "operation ok" indicator is driven by the module itself, while the fault indicator is driven redundantly by multiple modules (as discussed in more detail below). If the module is not functioning properly, the module no longer illuminates the "operation ok" indicator (this could be a result of the module determining itself that it has a problem and thus no longer driving the LED, or alternatively a problem existing with the power to or within the module causing no power to be provided to the LED driving circuitry). The "operation ok" no longer being illuminated can be sensed by a second module, resulting in the fault indicator for the module being activated. Sensing whether the "operation ok" indicator is illuminated can be done in any of a variety of manners, such as the current or voltage on the line driving the "operation ok" indicator being sensed to determine if the indicator is still being illuminated, or using a photo sensor could be used to determine if the indicator is still being illuminated.

Additional data and control information can also be communicated among the modules 102–106 via the bus 108. The exact nature of such additional data and control information is dependent on the nature of system 100 as well as the specific functions carried out by each of the modules 102–106. As the transfer of such additional data is not germane to the invention, it will not be discussed further.

LED module 110 includes multiple status LEDs 112 and 114 that indicate the operational status of corresponding modules 102 and 104, respectively. In the discussion to follow, reference is made to a single status LED indicating the operational status of each of the modules. Alternatively, additional status LEDs may be included for one or more of the modules.

As illustrated, modules 102 and 104 are both coupled to the status LED 112. Either of the modules 102 and 104 can drive the status LED 112 to indicate that module 102 has failed. Thus, if the power to module 102 were to fail or if there were a problem in the power distribution with module 102, module 104 would still be able to drive the status LED 112 and indicate (e.g., to the user or administrator) that module 104 has failed. Similarly, both of the modules 102 and 104 are coupled to the status LED 114, either of which can drive the status LED 112 to indicate that the module 104 has failed.

Alternatively, additional modules can be coupled to the status LEDs 112 and 114 to provide further redundancy of the status indicators. Thus, for example, if module 102 and three other modules were to drive the status LED 112, then the module 102 plus any two of the other three modules could fail and the status LED 112 would still be driven to indicate that the module 102 has failed.

Alternatively, module 110 includes other indicators in addition to or in place of status LEDs. One example of such other indicators is a conventional speaker that is driven to produce a particular frequency (e.g., an error tone or beep) upon failure of a module. Another example of such other indicators is a status register (e.g., a flash memory device). Upon failure of a module, the status register would be written to in order to indicate the failure. The status register could then be accessed by another device (not shown) being coupled to the system 100 and interrogating the status register.

Additional status LEDs (not shown) may also be included for any of the other n modules. The additional status LEDs can be driven redundantly by two or more modules analogous to status LEDs 112 and 114. However, these additional status LEDs have not been shown so as not to clutter the drawings.

Furthermore, rather than having a separate LED module 110 as illustrated, the individual status LEDs could be included as part of their respective (or other) modules.

Figure 2:
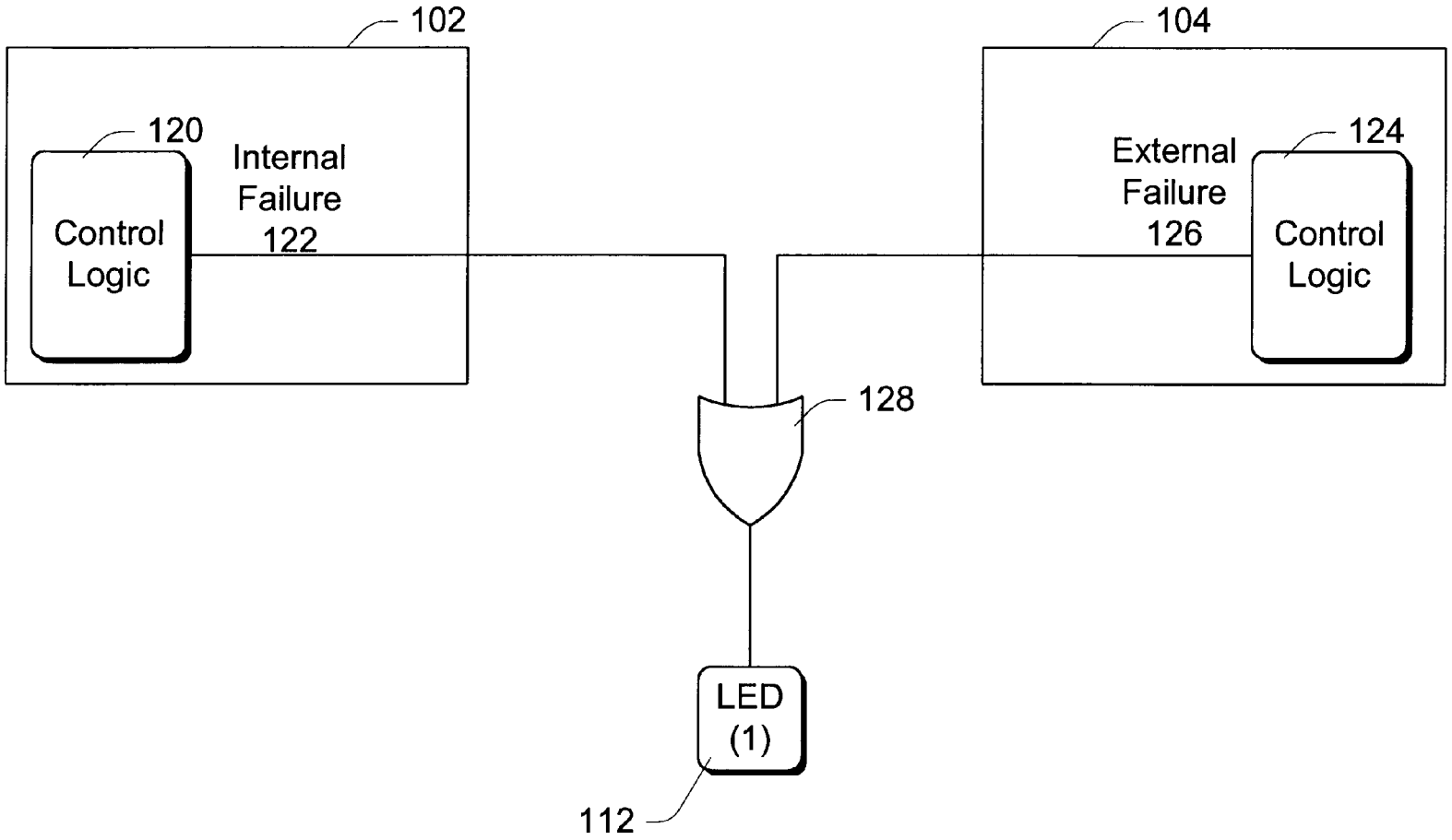
FIG. 2 is a block diagram illustrating exemplary redundant status indicators in accordance with the invention.

FIG. 2 is a block diagram illustrating exemplary redundant status indicators. For ease of explanation and to avoid cluttering the drawings, only the logic and circuitry used to provide one redundant status indicator is included in FIG. 2. It is to be appreciated that additional status indicators, although not shown, can also be included. Additional circuitry, analogous to that illustrated in FIG. 2, is included for each of the additional status indicators. Furthermore, it is to be appreciated that additional circuitry, although not shown, is also included in the modules 102 and 104 in accordance with their particular functions.

Module 102 includes control logic 120, which asserts an internal failure signal 122 when a failure of part or all of module 102 is detected. Control logic 120 can detect a failure internal to module 102 in any of a variety of conventional manners. For example, various error checking protocols may be employed to check data internal to the module 102 or being output by the module 102. If greater than a threshold number of errors are detected, then control logic 120 assumes that a failure of part of module 102 has occurred.

It should be noted that situations can arise where the voltage source powering control logic 120 fails, thereby preventing internal failure signal 122 from being asserted.

Module 104 includes a control logic 124 that asserts an external failure signal 126 when a failure of part or all of the module 102 is detected. Module 104 can detect certain failures in module 102 based on, for example, the monitoring of status indicators or polling via the bus 108 of FIG. 1.

The internal failure signal 1 22 and external failure signal 126 are input to a logical ORing component 128. Logical ORing component 128 in turn drives status LED 112. Thus, if module 102 detects an internal failure, or if module 104 detects a failure of module 102, then logical ORing component 128 drives LED 112 to illuminate.

Figure 3:
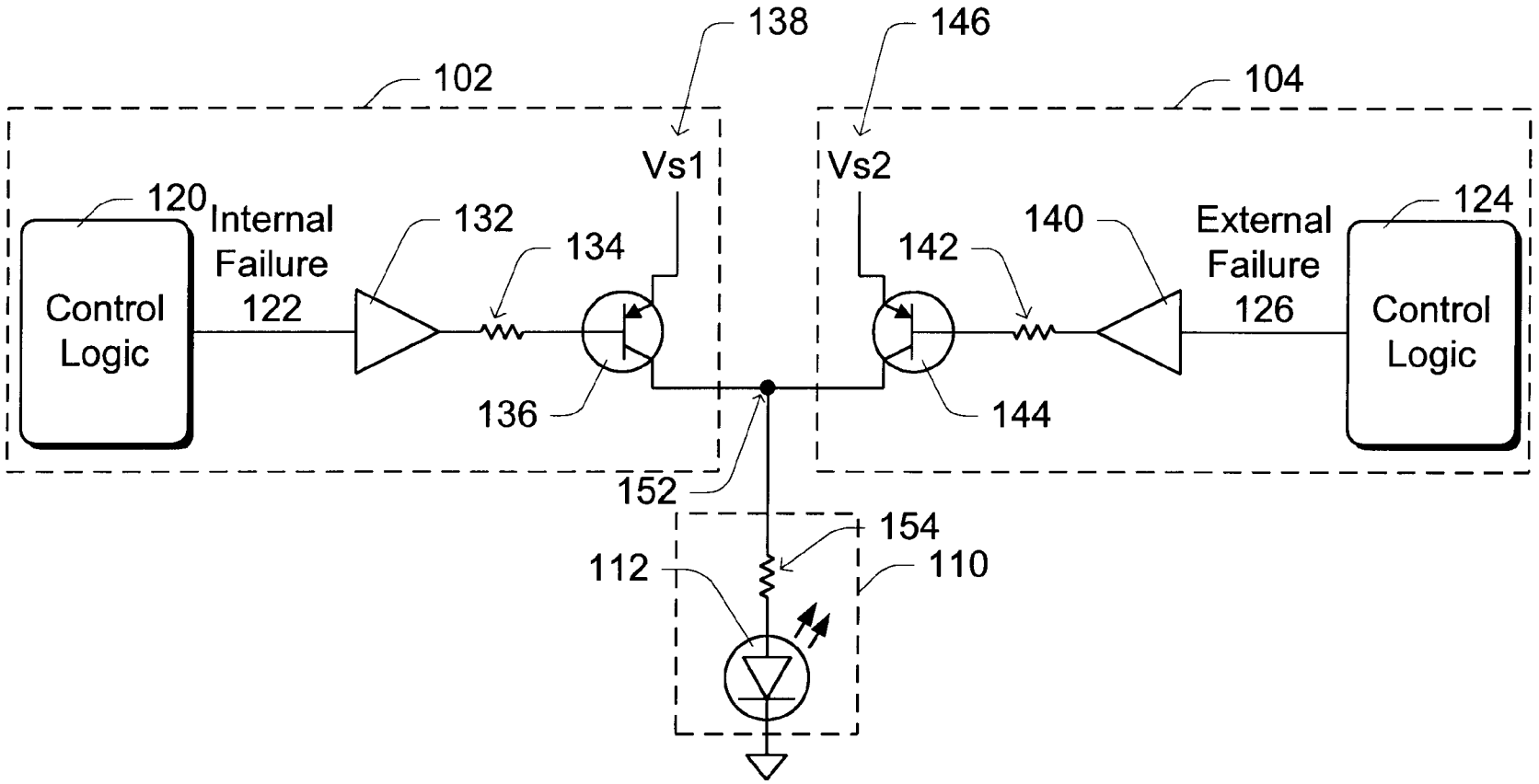
FIG. 3 illustrates exemplary circuitry for providing the redundant status indicators in accordance with the invention.

Logical ORing component 128 can be any of a variety of conventional logical ORing circuitry. One example of such logical ORing circuitry is shown in FIG. 3 below. Other examples include using diodes, using different transistor types and configurations, etc.

Therefore, it can be seen that if a failure in module 102 adversely affects its power source or power distribution within the module 102, module 104 can detect the failure. Thus, even if power to the module 102 fails, the LED 112 can still be illuminated to indicate that module 102 is faulty.

FIG. 3 illustrates exemplary circuitry for providing the redundant status indicators. For ease of explanation and to avoid cluttering the drawings, only the circuitry used to provide one redundant status indicator is included in FIG. 3. It is to be appreciated that additional status indicators, although not shown, can also be included. Additional circuitry, analogous to that illustrated in FIG. 3, is included for each of the additional status indicators. Furthermore, it is to be appreciated that additional circuitry, although not shown, is also included in the modules 102 and 104 in accordance with their particular functions.

Module 102 includes a driver 132, a resistor 134, a transistor 136, and a voltage source 138 coupled together as illustrated. Similarly, module 104 includes a driver 140, a resistor 142, a transistor 144 and a voltage source 146 coupled together as illustrated. Voltage sources 138 and 146 are two independent voltage sources which may also power other circuitry (not shown) of modules 102 and 104, respectively. In the exemplary modules of FIG. 3, voltage sources 138 and 146 are two electrically isolated power converters, which may in turn be coupled to the same or different power supplies.

In the illustrated circuitry, the resistors 134 and 142 are each a 3.3k ohm resistor, the buffers 132 and 140 are each a 74ALS1035 buffer available from, for example, Texas Instruments of Dallas, Tex. or National Semiconductor of Santa Clara, Calif., and the voltage sources 138 and 146 are each an LW010A981 power converter available from Lucent Technologies of Murray Hill, N.J.

Also in the illustrated circuitry, the transistors 136 and 144 are each an MMPQ2907A transistor available from Fairchild Semiconductor Corporation of South Portland, Me. Characteristics of the transistors 136 and 144 in the illustrated circuitry include the following. The transistors have a minimum collector-base breakdown voltage of −60 V (at 25° C.) with a current at the collector of −10 $\mu$A and a current at the emitter of 0. The transistors 136 and 144 also have a maximum collector cutoff current of −50 nA (at 25° C.) with a collector-base voltage of −30 V (or alternatively −50 V) and a current at the emitter of 0.

The input to driver 132 of module 102 is internal failure signal 122. Internal failure signal 122 is asserted by control logic 120 when a failure of part or all of module 102 is detected. Module 102 can detect a failure internal to module 102 in any of a variety of conventional manners, as discussed above.

The input to driver 140 of module 104 is external failure signal 126. External failure signal 126 is asserted by control circuitry 124 when a failure of part or all of the module 102 is detected. Module 104 can detect certain failures in module 102 based on, for example, the monitoring of other status indicators or polling via the bus 108 of FIG. 1.

Assertion of external failure signal 126 causes driver 140 to assert a signal through resistor 142 turning on transistor 144. Turning on transistor 144 creates an electrical coupling between voltage source 146 and node 152. Similarly, assertion of internal failure signal 122 in module 102 causes driver 132 to assert a signal through resistor 134 turning on transistor 136. Turning on transistor 136 provides an electrical coupling between voltage source 138 and node 152.

Coupling node 152 to a voltage source (either of sources 138 or 146) causes a current to pass through a resistor 154 and the status LED 112 of LED module 110, thereby causing the status LED 112 to illuminate. Thus, assertion of either internal failure signal 122 or external failure signal 126 causes the status LED 112 to illuminate, thereby indicating a failure of the module 102. In the illustrated circuitry, resistor 154 is a 1k ohm resistor, and LED 112 is an LED from the 597-2301-2xx or 597-2401-2xx families of LEDs available from Dialight Corporation of Manasquan, N.J.

Therefore, it can be seen that if a failure in module 102 includes either the power source 138 or the power distribution of module 102 including power source 138, module 104 can detect the failure. And, if the failure does not affect power source 146, the status LED 112 is illuminated by module 104. Thus, even if power to the module 102 fails, the LED 112 can still be illuminated due to the redundancy provided by module 104.

In the exemplary circuitry of FIG. 3, the modules 102 and 104 are described as asserting a signal to activate the LED 112 when a failure is detected. Alternatively, the modules 102 and 104 could continually assert a signal and, when at least one of the modules 102 and 104 stops asserting the signal, the LED 112 is activated. Such alternative configurations may use different logical combining circuitry other than the logical ORing circuitry. For example, signals from the modules 102 and 104 can be input to logical ANDing circuitry, the output of which controls the LED 112. As long as both the modules 102 and 104 are asserting their signals, the logical ANDing circuitry prevents activation of the LED 112. However, as soon as at least one of the modules 102 and 104 ceases asserting its signal, the logical ANDing device activates the LED 112.

Figure 4:
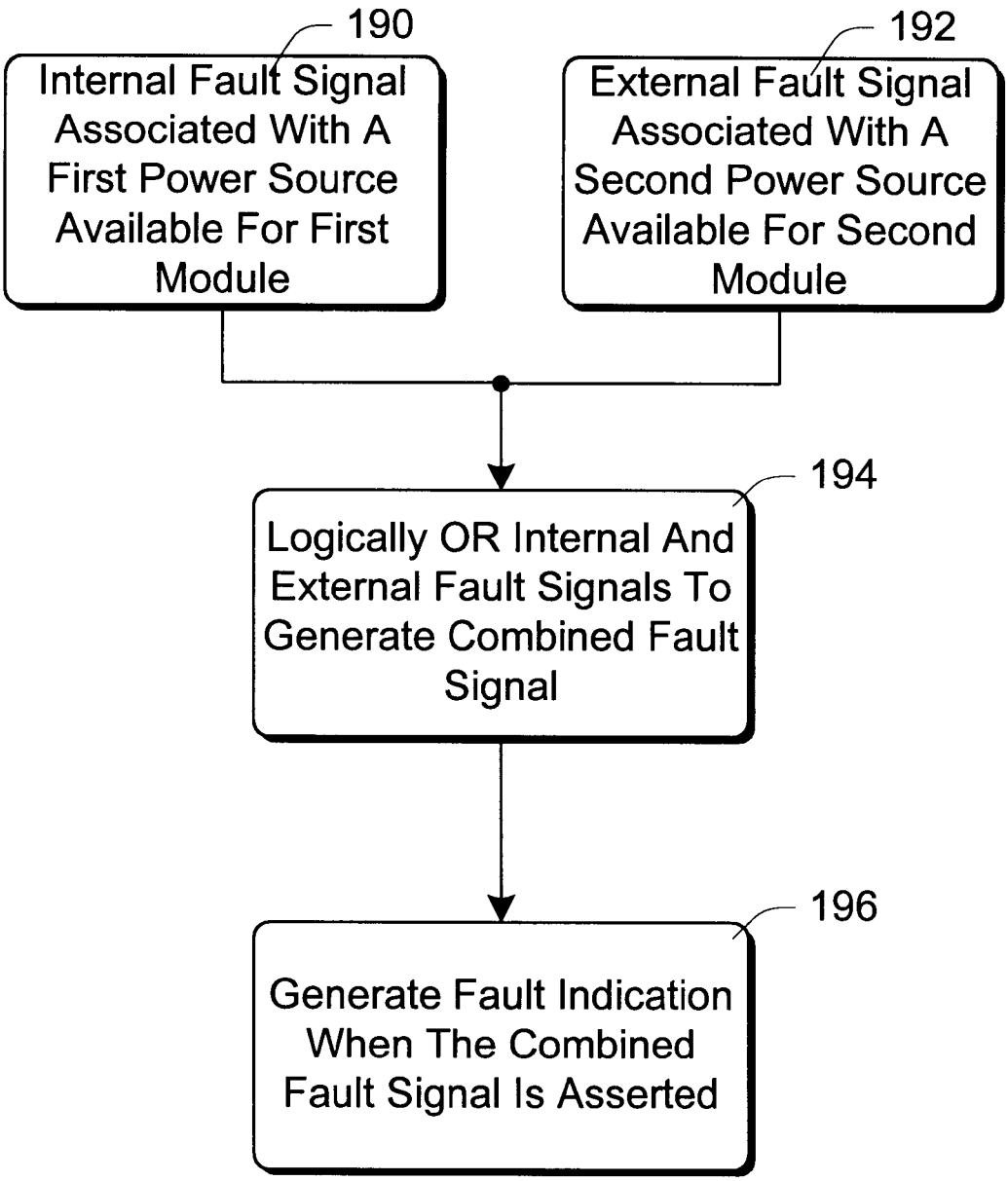
FIG. 4 is a flowchart illustrating exemplary steps for providing redundant status indicators in accordance with the invention.

FIG. 4 is a flowchart illustrating exemplary steps for providing redundant status indicators in accordance with the invention. The steps of FIG. 4 can be performed by any of a wide variety of conventional computing systems.

Initially, an internal fault signal associated with a first power source is available for a first module, step 190. The first module can assert the internal fault signal when it detects a fault in the first module. Concurrently, an external fault signal associated with a second power source is available to a second module, step 192. The second module can assert the external fault signal when it detects a fault in the first module.

The internal and external fault signals are logically OR'd together to generate a combined fault signal, step 194. This combined fault signal is then used to generate a fault indication when the first module becomes faulty, step 196. Thus, the fault indication can be generated by either the first or second modules.

The invention provides redundant status indicators for fault tolerance. Status indicators identifying the operational status of different modules within a system are advantageously driven redundantly by two or more of the modules. By redundantly driving the status indicators, a failed module can be indicated even though the failure may affect the power supply or other circuitry preventing that module from indicating the failure itself.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A system comprising:

a first module including first signal driving circuitry that is powered by a first power source and that operates based at least in part on whether the first module is faulty;

a second module including second signal driving circuitry that is powered by a second power source and that operates based at least in part on whether the first module is faulty;

status indicator circuitry, coupled to the first and second modules, to identify the first module as being faulty; and wherein the first signal driving circuitry and the second signal driving circuitry provide a logical combining function to drive the status indicator circuitry.

2. A system as recited in claim 1, wherein the logical combining function comprises a logical ORing function.

3. A system as recited in claim 1, wherein the second power source is independent of the first power source.

4. A system as recited in claim 1, wherein the status indicator circuitry includes a light emitting diode (LED).

5. A system as recited in claim 1, wherein the first and second signal driving circuitry each comprise:

a driver device coupled in series with a transistor.

6. A system as recited in claim 1, wherein the first and second signal driving circuitry each comprise:

a driver device coupled in series with a diode.

7. A system as recited in claim 1, wherein the status indicator circuitry is part of the first module.

8. A system as recited in claim 1, further comprising:

the first module including third signal driving circuitry powered by the first power source;

the second module including fourth signal driving circuitry powered by the second power source; and wherein the third signal driving circuitry and the fourth signal driving circuitry provide a second logical combining function to drive other status indicator circuitry when the second module is faulty.

9. A system comprising:

a first module including first signal driving circuitry powered by a first power source and third signal driving circuitry powered by the first power source;

a second module including second signal driving circuitry powered by a second power source and fourth signal driving circuitry powered by the second power source;

status indicator circuitry, coupled to the first and second modules, to indicate when the first module is faulty;

wherein the first signal driving circuitry and the second signal driving circuitry provide a logical combining function to drive the status indicator circuitry; and wherein the third signal driving circuitry and the fourth signal driving circuitry provide a logical ORing function to drive an indicator of the status indicator circuitry when the second module is faulty.

10. An apparatus comprising:

signal driving circuitry to provide a first signal indicating that the apparatus is faulty and to logically OR the first signal with a second signal, initiated by another apparatus, indicating that the apparatus is faulty; and status indicator circuitry to provide an indication, based on the logical ORing of the first and second signals, that the apparatus is faulty.

11. An apparatus as recited in claim 10, wherein the status indicator circuitry comprises a light emitting diode (LED).

12. An apparatus as recited in claim 10, wherein the signal driving circuitry comprises:

a driver device coupled in series to a transistor.

13. An apparatus as recited in claim 10, wherein the status indicator circuitry is to provide an indication that the apparatus, rather than the other apparatus, is faulty.

14. A method comprising:

associating an internal fault signal with a first module and a first power source, the internal fault signal being used to identify whether the first module is faulty;

associating an external fault signal with a second module and a second power source, the external fault signal being used to identify whether the first module is faulty; and logically combining the internal fault signal and the external fault signal to drive a status indicator.

15. A method as recited in claim 14, wherein the logically combining comprises logically ORing the internal fault signal and the external fault signal.

16. A method as recited in claim 14, wherein the status indicator comprises a visual indicator.

17. A method as recited in claim 14, wherein the second power source is independent of the first power source.

18. A computer-readable memory containing a computer program that is executable by a computer to perform the method recited in claim 14.

19. A method as recited in claim 14, further comprising:

associating another internal fault signal with the second module and the second power source;

associating another external fault signal with the first module and the first power source; and logically combining the other internal fault signal and the other external fault signal to drive another status indicator.

20. A method as recited in claim 14, wherein the logically combining comprises logically combining the internal fault signal and the external fault signal to drive a status indicator identifying that the first module rather than the second module is faulty.

* * * * *